United States Patent [19]

Saito

[11] 4,302,704

[45] Nov. 24, 1981

[54] POSTACCELERATION CATHODE RAY TUBE WITH A SCAN EXPANSION LENS

[75] Inventor: Kimiharu Saito, Nino, Japan

[73] Assignee: Iwatsu Electric Co., Ltd., Tokyo, Japan

[21] Appl. No.: 82,148

[22] Filed: Oct. 5, 1979

[30] Foreign Application Priority Data

Oct. 18, 1978 [JP] Japan ..... 53-127951

[51] Int. Cl.[3] ..... H01J 29/70

[52] U.S. Cl. ..... 315/17; 313/429

[58] Field of Search ..... 315/17, 15, 376; 313/429, 460

[56] References Cited

U.S. PATENT DOCUMENTS

| | | | |
|---|---|---|---|
| 2,412,687 | 12/1946 | Klemperer | 313/460 |
| 3,496,406 | 2/1970 | Deschamps | 315/17 |
| 4,142,128 | 2/1979 | Odenthal | 315/15 |

OTHER PUBLICATIONS

*Box lens design being tried by Tektronix in experimental CRTs,* Electronics, pp. 50 & 52, May 26, 1977.

*Primary Examiner*—Theodore M. Blum

*Attorney, Agent, or Firm*—Woodcock, Washburn, Kurtz, Mackiewicz & Norris

[57] ABSTRACT

A trapezoidal or rectangular box-shaped lens is incorporated, in combination with a postaccelerating electrode, in a cathode ray tube for amplification of beam deflections in both horizontal and vertical directions. Basically the lens comprises three lens elements or electrodes arranged end-to-end, with insulating gaps therebetween, so as to encompass the trajectories of the electron beam from the deflection system to the target of the CRT. For improvement of display characteristics the adjacent ends of not only the top and bottom sides, but also the right and left sides, of the electrodes of the lens system are oppositely curved to arcs that are convexed in prescribed directions. An end plate at the beam exit end of the target-side electrode has formed therein an elongate aperture extending in one of the orthogonal directions of beam deflection. The lens system provides a divergent action in one of the orthogonal directions and a doubly convergent action in the other.

12 Claims, 22 Drawing Figures

FIG. 1
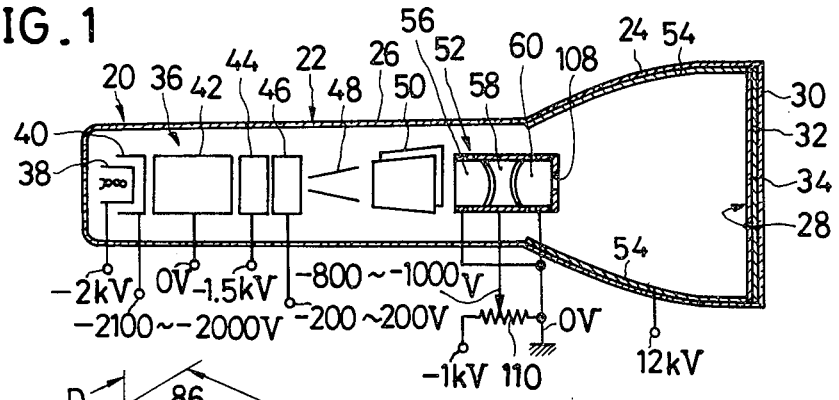
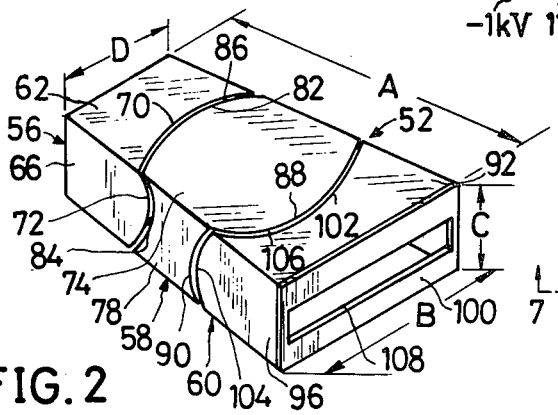
FIG. 2
FIG. 3
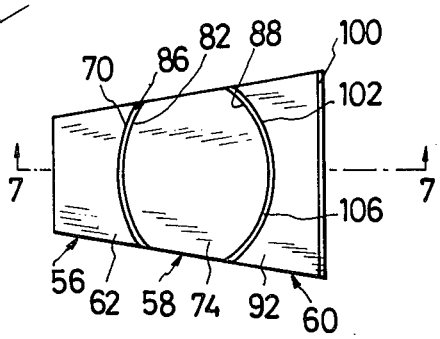
FIG. 4
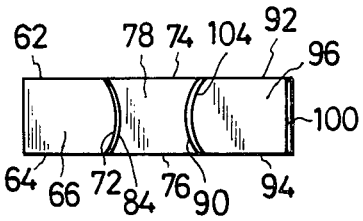
FIG. 6
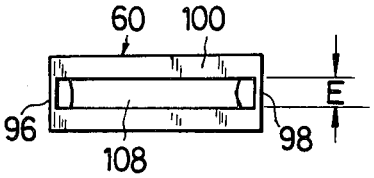
FIG. 5
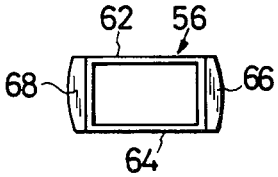
FIG. 7
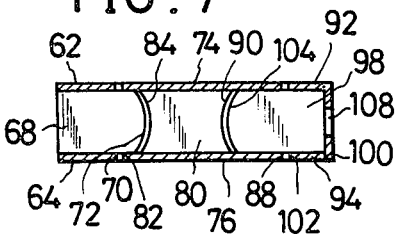

POSTACCELERATION CATHODE RAY TUBE WITH A SCAN EXPANSION LENS

BACKGROUND OF THE INVENTION

1. Field of the Invention

This invention pertains to cathode ray tubes (CRTs) of the type having an electron lens for amplifying the deflections of their electron beam, in combination with a postaccelerating or intensifier electrode. More specifically the invention concerns an improved electron lens for deflection amplification, herein referred to as a scan expansion lens, for particular use in oscilloscope and storage CRTs.

2. Description of the Prior Art

Postacceleration or postdeflection acceleration CRTs of usual prior art construction increase the velocity of their beam electrons, after they have traversed the deflection fields, by virtue of the accelerating field created by a planar or curved mesh and a postaccelerating electrode on the inside surface of the bulb or envelope. Thus postaccelerated, the beam provides a spot of increased brilliance on the fluorescent screen.

The mesh incorporated in this known type of CRTs, however causes a decrease in their electron gun efficiency, a defocusing of the beam spot on the screen, and halation due to secondary emission from the mesh. Recent effort in the electronics industry has therefore been directed toward the development of meshless postacceleration CRTs.

U.S. Pat. No. 3,496,406 to Deschamps describes and claims one such meshless postacceleration CRT, which comprises a quadrupolar electron lens for deflection amplification and a dome-shaped, apertured electrode. While capable of eliminating the drawbacks of the meshes to a certain extent, this postacceleration device possesses its own disadvantages such as the defocusing or nonuniformity of the spot upon increase in deflection angles. The device also requires the use of only the central portion of the electron beam to provide a spot of favorable characteristics, so that its electron gun efficiency is lower than that of the mesh-type postacceleration CRTs. The device also gives rise to pattern distortions, which can be eliminated only by two additional electrodes provided exclusively for that purpose.

Another example of meshless postacceleration CRT is disclosed in the article entitled, "'Box' Lens Design Being Tried by Tektronix in Experimental CRTs," on page 50 of the May 26, 1977, issue of *Electronics*. The article deals with a box-shaped, four-electrode scan expansion lens in which the four lens elements are shaped in alternating convergent and divergent geometries and arranged serially with insulating gaps therebetween. The box-shaped scan expansion lens defeats many of the limitations of the meshes. For truly satisfactory display characteristics, however, the lens must measure 2.5 by 4.2 by 1 inch to provide an 8-by-10-centimeter display. This makes the size of the CRT rather inordinately large.

SUMMARY OF THE INVENTION

It is an object of this invention to provide an improved scan expansion lens for use in various types of CRTs which affords high deflection sensitivity without spot defocusing.

Another object of the invention is to provide such an improved scan expansion lens which introduces a minimum of display distortions.

A further object of the invention is to provide such an improved scan expansion lens which is far smaller in size than known lenses of comparable design.

For the attainment of these and other objects the present invention provides a scan expansion lens system for use in a cathode ray tube of the type having an electron gun for producing a beam of electrons directed toward a target, deflection means for deflecting the beam in two orthogonal directions (i.e., horizontally and vertically), and a postaccelerating electrode encompassing the path of the beam on its way from the deflection means to the target. The lens system lies between the deflection means and the target, in such a position that at least the target-side or beam exit end of the lens system is acted upon by the field of the postaccelerating electrode.

Characteristically the lens system comprises at least three tubular electrodes of substantially rectangular cross-sectional shape disposed in axial alignment to permit the passage of the beam therethrough and electrically isolated from one another by intervening gaps. Each electrode has a first pair of opposite sides disposed in one of the orthogonal directions of beam deflection, and a second pair of opposite sides disposed at right angles with the first pair of opposite sides. Let it be assumed, to facilitate understanding, that the first pair of opposite sides are disposed horizontally and are therefore top and bottom sides. Then the second pair of opposite sides can be thought of as right and left sides.

According to the invention the adjacent ends of not only the top and bottom sides, but also the right and left sides of the electrodes are oppositely curved in arcs that are convexed in predetermined directions (i.e., toward the electron gun and toward the target) in a prescribed manner. One of the electrodes, lying closest to the target, additionally includes an end plate closing the beam exit end of the electrode and having formed therein an elongate aperture extending parallel to the top and bottom sides of the electrode. The geometrical center of this aperture substantially coincides with the axis of the nondeflected beam.

Thus, upon application of prescribed electrical potentials to the three electrodes of the lens system and to the postaccelerating electrode, the lens system substantially provides a diverging electron lens acting on the beam in one of the orthogonal directions (e.g., horizontally), and first and second converging electron lenses acting on the beam in the other direction (e.g., vertically). The second converging electron lens is created adjacent to the aperture of the target-side electrode and serves to converge the incoming beam which is diverging after having been converged by the first converging electron lens.

With its apertured end plate and oppositely curved adjacent ends of the right and left sides of the electrodes, the scan expansion lens system according to the invention overcomes the disadvantages and limitations of the noted prior art.

The above and other objects, features and advantages of the present invention and the manner of attaining them will become more apparent, and the invention itself will best be understood, from the following description read in connection with the accompanying drawings showing several embodiments of the invention.

BRIEF DESCRIPTION OF THE DRAWINGS

FIG. 1 is a schematic longitudinal sectional view of a CRT employing a preferred form of the scan expansion lens system according to the invention;

FIG. 2 is an enlarged perspective view of the lens system used in the CRT of FIG. 1;

FIG. 3 is a plan view of the lens system;

FIG. 4 is a side elevational view of the lens system;

FIG. 5 is an elevational view of the gun-side electrode of the lens system as seen from its beam entrance end directed toward the electron gun of the CRT of FIG. 1;

FIG. 6 is an elevational view of the target-side electrode of the lens system as seen from its beam exit end directed toward the target of the CRT;

FIG. 7 is a sectional view taken along the line 7—7 of FIG. 3;

DESCRIPTION OF THE PREFERRED EMBODIMENTS

Figure 8:
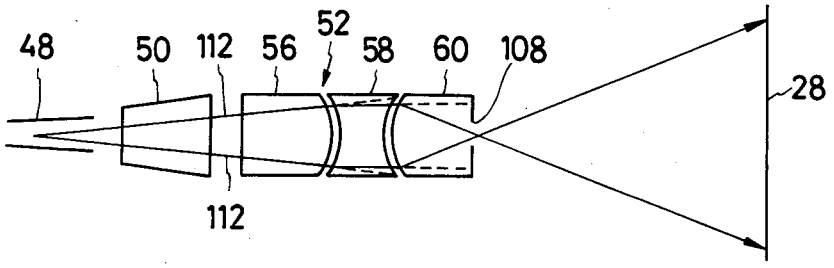
FIG. 8 is a schematic illustration of the deflection amplifying action of the lens system in a vertical direction.

With reference first to FIG. 1 of the above drawings the present invention is therein shown adapted for a CRT 20 of an electrostatic focus and deflection type for oscilloscopic applications. The exemplified CRT 20 includes an evacuated envelope 22 of glass or other suitable material. The envelope 22 includes a funnel portion 24 and a neck portion 26 integrally joined in axial alignment.

The funnel portion 24 of the envelope 22 has a target or screen 28 on its front end, directed to the right in FIG. 1. In this particular embodiment the target 28 comprises a glass faceplate 30, a phosphor layer 32 on the inside surface of the faceplate, and a conductive layer 34 further on the inside of the phosphor layer.

The neck portion 26 of the envelope 22 has mounted therein an electron gun 36 of conventional design comprising a cathode 38, a first grid 40, a second grid 42, a first anode 44, and a second anode 46. The electron gun 36 generally extends axially of the envelope neck portion 26 and generates a beam of electrons directed toward the target 28. On its way from electron gun 36 to target 28 the electron beam passes a pair of vertical deflection plates 48 and then a pair of horizontal deflection plates 50. The vertical deflection plate pair 48 and the horizontal deflection plate pair 50 deflect the electron beam in orthogonal directions, namely, vertically and horizontally, in the manner familiar to the specialists.

Disposed along the path of the electron beam, and between horizontal deflection plate pair 50 and target 28, is a trapezoidal box-shaped, three-element scan expansion lens system 52 according to the present invention. This lens system acts to amplify the vertical and horizontal deflections of the electron beam so as to provide full coverage of the target 28, as will be detailed presently.

The inside surface of the envelope funnel portion 24 bears a third anode or postaccelerating electrode 54 in the form of a conductive coating, which is joined to the conductive layer 34 of the target 28. Thus the postaccelerating electrode 54 encompasses the path of the electron beam. The location of the scan expression lens system 52 in relation to the postaccelerating electrode 54 is such that the field of the electrode 54 acts at least on the target-side or beam exit end of the lens system. This positional relationship between lens system 52 and postaccelerating electrode 54 is essential for the proper functioning of the lens system, as will become apparent as the description proceeds.

The CRT 20 employs the three-element scan expansion lens system 52 in lieu of the conventional mesh electrode. The parts other than the lens system 52 of the CRT 20 are each of conventional make and, as a whole, of conventional arrangement except for the noted positional relationship between lens system 52 and postaccelerating electrode 54.

Conventionally employed potentials can therefore be applied to the various electrodes of the CRT 20. For example, −2000 volt (V) may be applied to the cathode 38; −2100 to −2000 V to the first grid 40; 0 V to the second grid 42; −1500 V to the first anode 44; −200 to +200 V to the second anode 46; and 12,000 V to the postaccelerating electrode 54.

The first grid 40 controls the emission of electrons from the cathode 38. The emitted electrons in a beam are accelerated by the second grid 42 and then focused by the unipotential lens comprised of the second grid 42, the first anode 44 and the second anode 46. The focused electron beam is then deflected both vertically and horizontally by the electrostatic deflection system comprised of the vertical deflection plate pair 48 and the horizontal deflection plate pair 50. Subsequently the lens system 52 according to the invention amplifies the vertical and horizontal deflections of the electron beam so as to enable same to cover the complete area of the target 28.

FIGS. 2 through 7 are more detailed representations of the lens system 52. In this particular embodiment the lens system 52 comprises three substantially tubular electrodes or lens elements, that is, the first or gun-side electrode 56, the second or intermediate electrode 58, and the third or target-side electrode 60. All these electrodes 56, 58 and 60 have each a rectangular cross-sectional configuration and are disposed end-to-end in axial alignment with the path of the nondeflected beam. The lens system 52 as a whole is substantially box-shaped, the term "substantially" being used because the lens system is trapezoidal in shape when seen in a plan view as in FIG. 3, gradually increasing in width toward the target 28.

The gun-side electrode 56 of the lens system 52 comprises a first pair of opposite sides 62 and 64 disposed in one of the orthogonal directions of beam deflection, namely, horizontally, and a second pair of opposite sides 66 and 68 disposed at right angles with the first pair of opposite sides. The first pair of opposite sides 62 and 64 and the second pair of opposite sides 66 and 68 are each of exactly the same shape and size.

The beam exit ends 70, directed toward the target 28, of the first pair of opposite sides 62 and 64 are each curved in an arc of a prescribed radius that is convex in a first direction, that is, toward the electron gun 36. The beam exit ends 72 of the second pair of opposite sides 66 and 68 are each curved in an arc of a prescribed radius that is convex in a second direction opposite to the first direction, that is, toward the target 28.

The intermediate electrode 58 of the lens system 52 likewise comprises a third pair of opposite sides 74 and 76 disposed in coplanar relationship to the first pair of opposite sides 62 and 64, respectively, of the gun-side electrode 56, and a fourth pair of opposite sides 78 and 80 disposed in coplanar relationship to the second pair of opposite sides 66 and 68, respectively, of the gun-side electrode. The third pair of opposite sides 74 and 76 and the fourth pair of opposite sides 78 and 80 are also each of exactly the same shape and size.

The beam entrance ends 82, directed toward the electron gun 36, of the third pair of opposite sides 74 and 76 are shaped in conformity with the beam exit ends 70 of the first pair of opposite sides 62 and 64. Thus, in this particular embodiment, the beam entrance ends 82 of the third pair of opposite sides 74 and 76 are each curved in an arc convex toward the electron gun 36. The beam entrance ends 84 of the fourth pair of opposite sides 78 and 80 are also shaped in conformity with the beam exit ends 72 of the second pair of opposite sides 66 and 68, each end 84 being curved in an arc convex toward the target 28.

A gap 86 exists between gun-side electrode 56 and intermediate electrode 58. This gap must be sufficient to afford electrical insulation between the two electrodes 56 and 58.

The beam exit ends 88 of the third pair of opposite sides 74 and 76 of the intermediate electrode 58 are each curved in an arc of a prescribed radius that is convex in said second direction, that is, toward the target 28. The beam exit ends 90 of the fourth pair of opposite sides 78 and 80 are each curved in an arc of a prescribed radius that is convex in said first direction, that is, toward the electron gun 36.

The target-side electrode 60 of the lens system 52 comprises a fifth pair of opposite sides 92 and 94, a sixth pair of opposite sides 96 and 98, and an apertured end plate 100 closing the beam exit end of the target-side electrode. The fifth pair of opposite sides 92 and 94 are disposed in coplanar relationship to the third pair of opposite sides 74 and 76, respectively, of the intermediate electrode 58 and thus to the first pair of opposite sides 62 and 64, respectively, of the gun-side electrode 56. The sixth pair of opposite sides 96 and 98 are disposed in coplanar relationship to the fourth pair of opposite sides 78 and 80, respectively, of the intermediate electrode 58 and thus to the second pair of opposite sides 66 and 68, respectively, of the gun-side electrode 56. The fifth pair of opposite sides 92 and 94 and the sixth pair of opposite sides 96 and 98 are also each of exactly the same shape and size.

The beam entrance ends 102 of the fifth pair of opposite sides 92 and 94 of the target-side electrode 60 are shaped correspondingly to the beam exit ends 88 of the third pair of opposite sides 74 and 76 of the intermediate electrode 58, each end 102 being curved in an arc convex toward the target 28. The beam entrance ends 104 of the sixth pair of opposite sides 96 and 98 of the target-side electrode 60 are shaped correspondingly to the beam exit ends 90 of the fourth pair of opposite sides 78 and 80 of the intermediate electrode 58, each end 104 being curved in an arc convex toward the electron gun 36.

Between intermediate electrode 58 and target-side electrode 60 there also exists a gap 106 sufficient to provide electrical insulation therebetween. The various opposed arcuate ends 70, 72, 82, 84, 88, 90, 102 and 104 of the lens system electrodes 56, 58 and 60 are so shaped that the midpoint of each end, in the transverse direction of the lens system, coincides with the vertex of the arc into which it is shaped.

The aforesaid apertured end plate 100 is welded or otherwise affixed to the beam exit end of the target-side electrode 60. The aperture 108 in this end plate 100 take the form of an elongate slot extending parallel to the fifth pair of opposite sides 92 and 94 of the target-side electrode 60, substantially the full length of the end plate. The aperture 108 is located centrally of the end plate 100 with respect to its dimension parallel to the sixth pair of opposite sides 96 and 98 of the target-side electrode 60. Thus the geometrical center of the aperture 108 coincides, at least approximately, with the axis of the electron beam passing the aperture without having been deflected by the deflection system of the CRT 20.

The following is the preferred dimensional specifications of the scan expansion lens system 52 for use in the CRT 20 whose screen size is assumed to be 8 by 10 centimeters (cm). The lens system 52 as a whole has an axial length A of 42 millimeters (mm), a beam exit end width B of 35 mm, a height or thickness C of 13 mm, and a beam entrance end width D of 20 mm. The end plate aperture 108 has a width E of 6 mm.

The arcuate beam exit ends 70 of the first pair of opposite sides 62 and 64 of the gun-side electrode 56 have each a radius of curvature of 28 mm, and the arcuate beam-entrance ends 82 of the third pair of opposite sides 74 and 76 of the intermediate electrode 58 have each a radius of curvature of 27 mm. The arcuate beam exit ends 72 of the second pair of opposite sides 66 and 68 of the gun-side electrode 56 have each a radius of curvature of 9 mm, and the arcuate beam-entrance ends 84 of the fourth pair of opposite sides 78 and 80 of the intermediate electrode 58 have each a radius of curvature of 10 mm. The arcuate beam-exit ends 88 of the third pair of opposite sides 74 and 76 of the intermediate electrode 58 have each a radius of curvature of 16 mm, and the arcuate beam entrance ends 102 of the fifth pair of opposite sides 92 and 94 of the target-side electrode 60 have each a radius of curvature of 17 mm. The arcuate beam exit ends 90 of the fourth pair of opposite sides 78 and 80 of the intermediate electrode 58 have each a radius of curvature of 11 mm, and the arcuate beam entrance ends 104 of the sixth pair of opposite sides 96 and 98 of the target-side electrode 60 have each a radius of curvature of 10 mm.

The gap 86 between gun-side electrode 56 and intermediate electrode 58 and the gap 106 between intermediate electrode 58 and target-side electrode 60 are therefore each one mm in width. All these electrodes 56, 58 and 60 are formed of 0.5 mm thick nonmagnetic stainless steel sheets.

In order to derive full benefits from the aperture 108 in the end plate 100 of the target-side electrode 60, its width E should be in the range of from about 1/5 to 3/5 of the height C of the lens system 52. Further the beam exit end width B of the lens system 52 should be from about 2.5 to 5.0 times its height C in order to provide a CRT of small size and high deflection sensitivity.

With reference back to FIG. 1 the CRT 20 is provided with a voltage supply circuit in the form of a potentiometer 110 for application of desired operating potentials to the three electrodes 56, 58 and 60 of the lens system 52. In the operation of this CRT 20 the gun-side electrode 56 and target-side electrode 60 of the lens system 52 are maintained at potentials higher than the potential (−2000 V) of the cathode 38 of the electron gun 36 but lower than the potential (12,000 V) of the postaccelerating electrode 54. The intermediate electrode 58 is maintained at a potential lower than the potentials of the other electrodes 56 and 60. Thus the potentiometer 110 applies, for example 0 V to the gun-side 56 and target-side 60 electrodes, and −1000 to −800 V to the intermediate electrode 58.

For the proper functioning of the lens system 52 the field of the postaccelerating electrode 54 must act stably on the aperture 108 in the end plate 100 of its target-side electrode 60. Toward this end the lens system 52 may be so located that the postaccelerating electrode 54 encircles at least its apertured end plate 100 as shown. This arrangement is not of absolute necessity, however; the apertured end plate 100 may be disposed more or less close to the gun-side end of the postaccelerating electrode 54, provided that the field of the postaccelerating electrode acts positively on the aperture 108.

According to one of the features of the scan expansion lens system 52 of the foregoing construction, arcuate gaps separate not only the tops and bottoms (as seen in FIG. 2 for example), but also the opposite lateral sides, of the electrodes 56, 58 and 60. Further the arcuate gaps between the tops and bottoms of any two adjacent electrodes are oriented opposite to the arcuate gaps between the lateral sides of the two adjacent electrodes. A further feature resides in the apertured plate 100 at the beam exit end of the target-side electrode 60. How these inventive features contribute to the attainment of the above recited objects of the invention will become clear from the following description of operation.

OPERATION

In the operation of the scan expansion lens system 52, O V may be applied as aforesaid to its gun-side 56 and target-side 60 electrodes, and −1000 to −800 V to its intermediate electrode 58, from the potentiometer 110. The potentials applied to the various electrodes of the CRT 20 have already been set forth. FIG. 8 shows the consequent action of the lens system 52 in a vertical direction, and FIG. 9 shows its action in a horizontal direction.

In FIG. 8 the solid lines 112 depict the outer trajectories of the electron beam that has been deflected vertically by the vertical deflection plate pair 48 of the CRT 20. Within the lens system 52 the electron beam does not follow the phantom straight-line paths but follows the solid-line trajectories 112. Then, passing the aperture 108 in the end plate 100 of the target-side electrode 60, the beam bombards the target 28.

Figure 9:
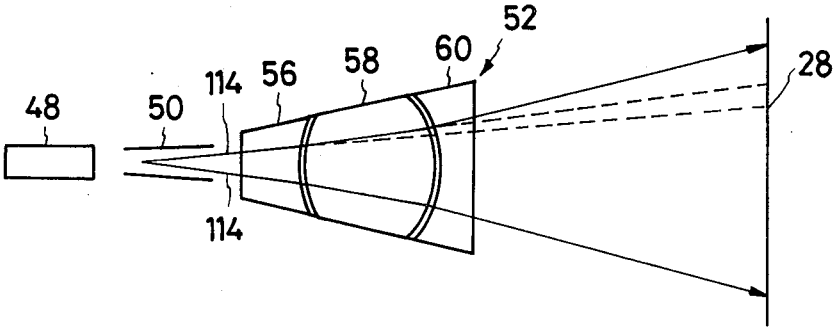
FIG. 9 is a schematic illustration of the deflection amplifying action of the lens system in a horizontal direction.

FIG. 9 represents the outer trajectories 114 of the electron beam that has been deflected horizontally by the horizontal deflection plate pair 50. The beam does not follow the phantom straight-line paths but, with its horizontal deflection angle magnified by the lens system 52, follows the solid-line trajectories 114 to the target 28 through the lens system aperture 108.

Figure 10:
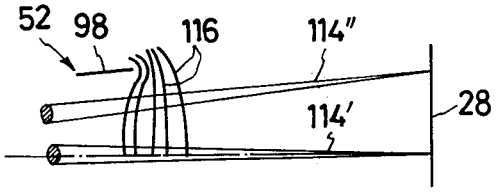
FIG. 10 explains the relationship between beam trajectories and equipotential lines created horizontally at and adjacent the aperture at the beam exit end of the lens system.

FIG. 10 gives the equipotential lines 116 demonstrating the horizontal potential distribution at and adjacent the lens system aperture 108, due to the potential difference between target-side electrode 60 and postaccelerating electrode 54. The horizontal equipotentials are so linear that they hardly affect the beam following the various trajectories 114' and 114'' in a horizontal direction, permitting the beam to focus correctly on the target 28 regardless of its trajectories.

Figure 11:
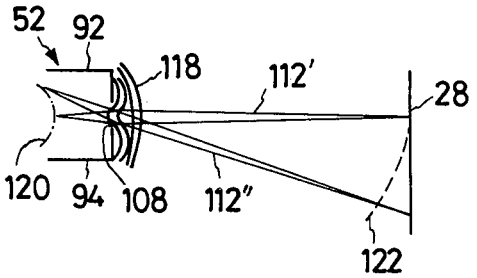
FIG. 11 explains the relationship between beam trajectories and equipotential lines created vertically at and adjacent the lens system aperture.

The vertical potential distribution at and adjacent the lens system aperture 108, on the other hand, is as represented by the equipotential lines 118 of FIG. 11. Parts of these equipotentials 118 bulge out into the target-side electrode 60 through its aperture 108 thereby forming a converging electron lens. Thus the electron beam that enters the lens system 52 in a converging state is first focused by a converging electron lens within the lens system, then starts diverging, and then is again focused (this time on the target 28) by the second converging lens created adjacent the lens system aperture as above.

Since the vertical potential distribution adjacent the lens system aperture 108 is as depicted in FIG. 11, the electron beam following the axial trajectory 112' receives the action of the second converging lens to a greater extent than the beam tracing the outer (upper and lower) trajectories, such as that indicated at 112''. The aforesaid first converging lens formed by the three electrodes 56, 58 and 60 of the lens system 52, excluding its apertured end plate 100, is such that its convergent action is less intense at and adjacent the lens axis than at its upper and lower end portions. Consequently the focal points of the beam that has traversed the first converging lens along the various trajectories in a vertical direction make up an arcuate locus indicated at 120 in FIG. 11.

Thus, were it not for the second converging lens adjacent the lens system aperture 108, the beam that has left the lens system 52 would focus along the dashed arcuate line 122 of FIG. 11. The result would be the defocusing, on the target 28, of the beam that had followed the trajectories other than the axial one. The screen display of the CRT 20 would thus blur, particularly at its top and bottom portions. Thanks to the presence of the second converging lens created adjacent the lens system aperture 108, however, no such blurring takes place, as the beam that has traveled along the various trajectories in a vertical direction is all correctly focused on the target 28 as in FIG. 11.

The foregoing will have made clear the functions of the lens system aperture 108. The location, width and other characteristics of this aperture deserve utmost consideration for enabling same to effectively compensate for the arcuate locus 120 of the focal points of the first converging lens. Such characteristics of the lens system aperture 108 must also be determined in relation to the position in which the electron beam shifts its traveling direction within the lens system 52, for the aperture should accommodate the passage of substantially all the beam electrons therethrough. Properly dimensioned and positioned, the apertured end plate 100 will materially contribute to the uniformity of the beam spot size on the target 28 thereby improving the quality of display.

Figure 12A:
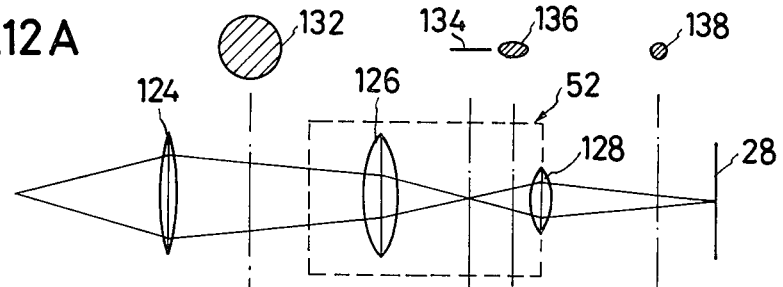
FIG. 12A illustrates by simplified optical analogy the vertical focusing action of the lens system.
Figure 12B:
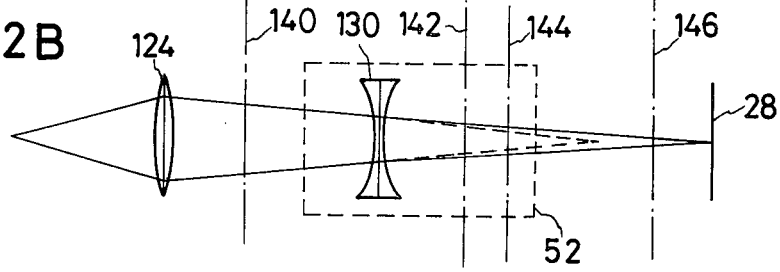
FIG. 12B illustrates by simplified optical analogy the horizontal focusing action of the lens system.

FIG. 12A is an illustration of a simplified optical analogy to the above explained vertical focusing action of the CRT 20 including the lens system 52, and FIG. 12B is a similar illustration of the horizontal focusing action of the CRT. FIG. 12A corresponds to FIGS. 8 and 11, and FIG. 12B corresponds to FIGS. 9 and 10.

A converging lens 124 seen in FIG. 12A is an optical equivalent to the combination of the second grid 42, first anode 44 and second anode 46. FIG. 12A also shows the first converging lens 126 formed by, and within, the lens system 52 excluding its apertured end plate 100, and the second converging lens 128 formed adjacent the end plate aperture 108.

Thus the lens system 52 substantially provides the two converging lenses 126 and 128 for the vertical focusing of the electron beam. The first converging lens 126 focuses the beam at a point some distance before the second lens 128. The beam enters the second converging lens 128 in a diverging state and is thereby refocused on the target 28.

The converging lens 124 in FIG. 12B is the same as the lens 124 of FIG. 12A. A diverging lens 130 is created by the lens system 52 for horizontally amplifying the deflection of the beam, as has been explained in connection with FIGS. 9 and 10.

FIGS. 12A and 12B also show the cross-sectional shapes 132, 134, 136 and 138 of the electron beam in planes indicated at 140, 142, 144 and 146, respectively. These cross-sectional beam shapes result from the combination of the above discussed vertical and horizontal focusing actions of the CRT 20.

Figure 13:
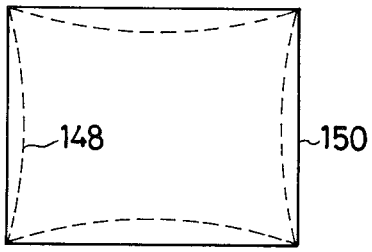
FIG. 13 depicts a correct pattern display by solid lines and a distorted pattern display by dashed lines.

Generally, CRTs having scan expansion lenses arranged posterior to their deflection systems tend to suffer distortions of the pattern displayed on the targets or screens. The pattern distortions may occur in a vertical or a horizontal direction or both. FIG. 13 shows such a distorted pattern 148 as distinguished from an undistorted pattern 150. The illustrated pattern 148 is said to have "pincushion distortion," with all four sides being concave. The improved scan expansion lens system 52 according to this invention introduces no such pattern distortions for the following reasons.

The beam entrance ends 82 of the pair of opposite sides 74 and 76 of the intermediate electrode 58 of the lens system 52 are convexed toward the electron gun 36, and the opposed beam exit ends 70 of the pair of opposite sides 62 and 64 of the gun-side electrode 56 are convexed correspondingly. Further the beam exit ends 88 of the pair of opposite sides 74 and 76 of the intermediate electrode 58 are convexed toward the target 28, and the opposed beam entrance ends 102 of the pair of opposite sides 92 and 94 of the target-side electrode 60 are convexed correspondingly. Thus the lens system 52 exerts a comparatively strong convergent action on the electron beam traveling adjacent to the pair of opposite sides 74 and 76 of the intermediate electrode 58 and at their mid-portions with respect to the transverse direction of the lens system, thereby correspondingly magnifying the vertical deflection of the beam tracing such trajectories.

The beam entrance ends 84 of the pair of opposite sides 78 and 80 of the intermediate electrode 58 are convexed toward the target 28, and the opposed beam exit ends 72 of the pair of opposite sides 66 and 68 of the gun-side electrode 56 are convexed correspondingly. Further the beam exit ends 90 of the pair of opposite sides 78 and 80 of the intermediate electrode 58 are convexed toward the electron gun 36, and the opposed beam entrance ends 104 of the pair of opposite sides 96 and 98 of the target-side electrode 60 are convexed correspondingly. Thus the lens system 52 exerts a comparatively strong divergent action on the electron beam passing adjacent to the pair of opposite sides 78 and 80 of the intermediate electrode 58 and at their mid-portions in a vertical direction, thereby correspondingly amplifying the horizontal deflection of the beam following such trajectories.

In this manner the improved scan expansion lens system 52 according to the invention effectively eliminates the pincushion distortion of FIG. 13, enabling the CRT 20 to display the correct pattern 150.

Advantageously the vertical deflection sensitivity of the CRT 20, incorporating the lens system 52 as above, is from about 30 to 40% higher than those of the conventional mesh-type CRTs. This advantage results from the two converging electron lenses 126 and 128, FIG. 12A, created by the lens system 52 for amplification of vertical beam deflection.

The horizontal deflection sensitivity of the CRT 20 is also from about 30 to 40% higher than those of the conventional mesh-type CRTs. One reason for this is that as seen in a plan view as in FIGS. 3 and 9, the lens system 52 is trapezoid-shaped, with its opposite sides extending substantially parallel to the outermost trajectories of the horizontally deflected beam. Another reason is that the opposed ends 72, 84, 90 and 104 of the second, fourth and sixth pairs of opposite sides of the three lens system electrodes 56, 58 and 60 are all curved so as to apply greater divergence to the horizontally deflected beam.

According to a further advantage of the invention the size of the lens system 52 can be reduced to a minimum. This is firstly because the lens 126 of FIG. 12A is highly converging and the lens 130 of FIG. 12B is highly diverging. Secondly the voltage-resisting ability of the lens system 52 can be comparatively low, since the required potential difference between gun-side 56 and intermediate 58 electrodes and that between intermediate 58 and target-side 60 electrodes are both only about 1000 V. Thus the size of the improved lens system according to the invention is less than half as large as that of the prior art lens described in the above referenced May 26, 1977, issue of *Electronics*.

One of the features of the lens system 52 is that it creates electron lenses not only by its intermediate 58 and target-side 60 electrodes but also by its gun-side 56 and intermediate 58 electrodes. Thus the lens system 52 effects the directional changes of the electron beam and the expansion of deflection angles by multiple stages, affording a beam spot of higher quality than that produced by the use of a single-stage system. This feature also permits easier adjustment of deflection angles and easier adjustment of the lens system aperture in relation to the deflection angles. Dispensing with the conventional mesh, moreover, the CRT 20 employing the lens system 52 has its electron gun efficiency improved about 50% as compared with that of the mesh-type CRT.

MODIFICATIONS

The scan expansion lens system according to the present invention is subject to a wide variety of modifications within the broad teaching hereof. Several representative ones of such modifications will be discussed in the following. Some parts of these representative modifications are identical with the corresponding parts of the lens system 52. Such parts will therefore be identified, as required, by the same reference numerals as used to denote the corresponding parts of the lens system 52, and their description will be omitted.

Figure 14:
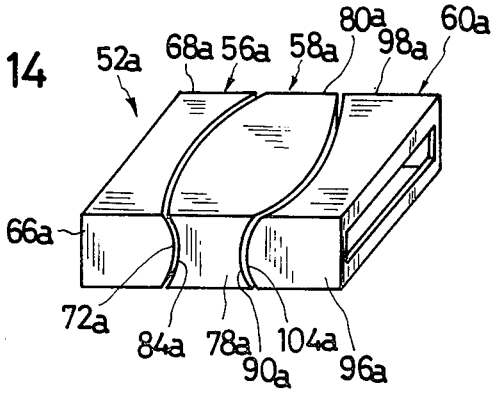
FIG. 14 is a perspective view of a modified scan expansion lens system according to the invention.

FIG. 14 shows one such modified lens system 52*a*, which is exactly rectangular or boxlike in shape, instead of being trapezoid-shaped as seen in a plan view as in the case of the first described lens system 52. With this boxlike configuration the second, fourth and sixth pairs of opposite sides 66*a*, 68*a*, 78*a*, 80*a*, 96*a* and 98*a* of three constituent electrodes 56*a*, 58*a* and 60*a* lie progressively farther away from the trajectories of the electron beam than the corresponding sides of the lens system 52. The opposed ends 72*a*, 84*a*, 90*a* and 104*a* of these sides are therefore curved in arcs of greater radii than are the corresponding opposed ends in the lens system 52. The modified lens system 52*a* is identical in the other constructional and operational details with the system 52 and gains the same advantages therewith.

Figure 15:
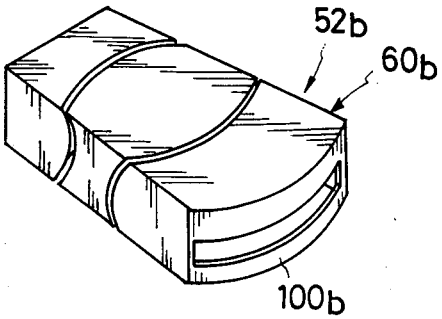
FIG. 15 is a perspective view of another modified lens system.

According to another modified lens system 52*b* shown in FIG. 15, the beam exit end of a target-side electrode 60*b* is curved in an arc that is convex toward the target. An apertured end plate 100*b* at the beam exit end of the target-side electrode 60*b* is also curved correspondingly. This arrangement may be resorted to for adjusting the deflection amplifying characteristics of the lens system as required.

Figure 16:
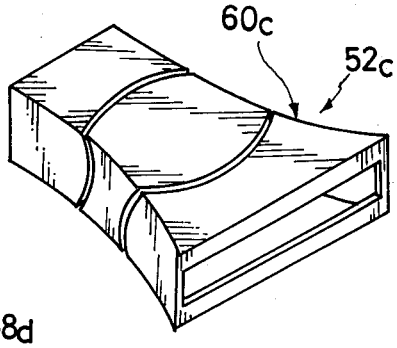
FIG. 16 is a perspective view of still another modified lens system.

Still another modified lens system 52*c* of FIG. 16 is generally bell-shaped as seen in a plan view, with its target-side electrode 60*c* having a noticeable flare. The other details are identical with those of the lens system 52.

Figure 17:
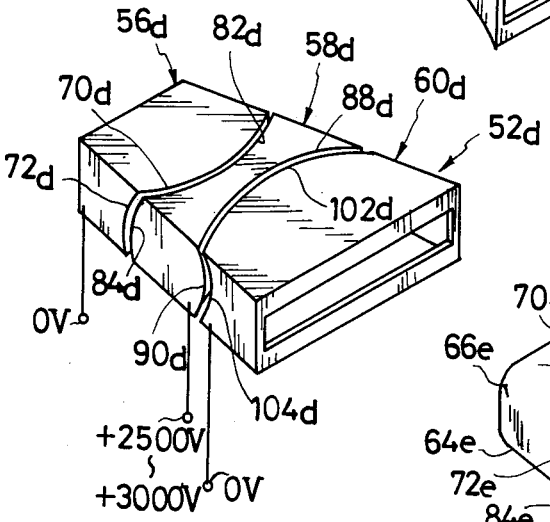
FIG. 17 is a perspective view of a further modified lens system.

FIG. 17 shows a further modified lens system 52*d*, in which the various opposed ends of its electrodes 56*d*, 58*d* and 60*d* are convexed in the opposite directions to the convexities of the corresponding ends in the lens system 52. Thus the opposed ends 70*d* and 82*d* of the first pair of opposite sides of the gun-side electrode 56*d* and the third pair of opposite sides of the intermediate electrode 58*d* are curved in arcs convex toward the target. The opposed ends 72*d* and 84*d* of the second pair of opposite sides of the gun-side electrode 56*d* and the fourth pair of opposite sides of the intermediate electrode 58*d* are curved in arcs convex toward the electron gun. The opposed ends 88*d* and 102*d* of the third pair of opposite sides of the intermediate electrode 58*d* the fifth pair of opposite sides of the target-side electrode 60*d* are curved in arcs convex toward the electron gun. The opposed ends 90*d* and 104*d* of the fourth pair of opposite sides of the intermediate electrode 58*d* and the sixth pair of opposite sides of the target-side electrode 60*d* are curved in arcs convex toward the target.

Such being the construction of the modified lens system 52*d*, in its operation the gun-side 56*d* and target-side 60*d* electrodes are maintained at ground potential, and the intermediate electrode 58*d* at +2500 to 3000 V, for example. The other details of construction and operation can be identical with those of the lens system 52.

Figure 18:
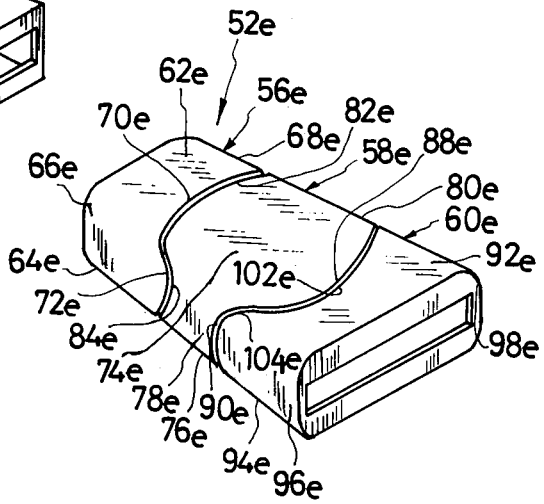
FIG. 18 is a perspective view of a still further modified lens system.

In a further modified lens system 52*e* shown in FIG. 18, the edges between the sides of its three electrodes 56*e*, 58*e* and 60*e* are all rounded, so that the lens system is substantially eliptical in cross-sectional shape. Nevertheless it will be seen that the gun-side electrode 56*e* of the lens system 52*e* has substantially four sides 62*e*, 64*e*, 66*e* and 68*e*, that the intermediate electrode 58*e* has substantially four sides 74*e*, 76*e*, 78*e* and 80*e*, and that the target-side electrode 60*e* has substantially four sides 92*e*, 94*e*, 96*e* and 98*e*, all as in the lens system 52. Further the opposed ends 70*e* and 82*e*, 72*e* and 84*e*, 88*e* and 102*e*, and 90*e* and 104*e* of these electrodes are all curved just like the corresponding electrode ends of the lens system 52. This modified lens system 52*e* is therefore essentially equivalent to the lens system 52.

Figure 19:
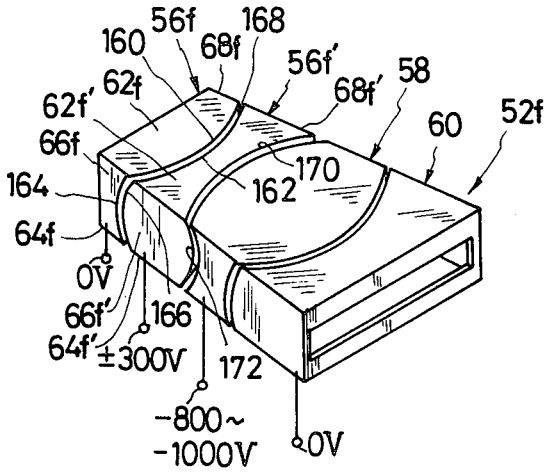
FIG. 19 is a perspective view of a yet further modified lens system.

FIG. 19 shows a still further modified lens system 52*f*, in which the gun-side electrode 56 of the lens system 52 is divided into a gun-side electrode 56*f* and a first intermediate electrode 56*f'*. The lens system 52*f* additionally comprises the second intermediate electrode 58 identical with the intermediate electrode of the lens system 52, and the target-side electrode 60 identical with the target-side electrode of the lens system 52.

The gun-side electrode 56*f* of the lens systems 52*f* comprises a pair of opposite sides 62*f* and 64*f* and another pair of opposite sides 66*f* and 68*f*. The first intermediate electrode 56*f'* comprises a pair of opposite sides 62*f'* and 64*f'* and another pair of opposite sides 66*f'* and 68*f'*. The beam exit ends 160 of the pair of opposite sides 62*f* and 64*f* of the gun-side electrode 56*f* and the opposed beam entrance ends 162 of the pair of opposite sides 62*f'* and 64*f'* of the first intermediate electrode 56*f'* are correspondingly curved in arcs convex toward the target.

The beam exit ends 164 of the pair of opposite sides 66*f* and 68*f* of the gun-side electrode 56*f* and the opposed beam entrance ends 166 of the pair of opposite sides 66*f'* and 68*f'* of the first intermediate electrode 56*f'* are correspondingly curved in arcs convex toward the electron gun. Between gun-side electrode 56*f* and first intermediate electrode 56*f'* there exists a gap 168 sufficient to provide electrical insulation therebetween.

The beam exit ends 170 of the pair of opposite sides 62*f'* and 64*f'* of the first intermediate electrode 56*f'* are each curved in an arc convex toward the electron gun. The beam exit ends 172 of the pair of opposite sides 66*f'* and 68*f'* of the first intermediate electrode 56*f'* are each curved in an arc convex toward the target. The other constructional details of the lens system 52*f* are exactly as set forth above in connection with the lens system 52.

In the operation of the lens system 52*f* the gun-side electrode 56*f* may be maintained at ground potential, and the first intermediate electrode 56*f'* at −300 to +300 V, for example. This lens system 52*f* permits correction of display distortions through adjustment of the potential applied to the first intermediate electrode 56*f'*. It is likewise possible to adjust deflection angles as well as convergent and divergent actions of the lens system.

If desired the gun-side electrode 56 of the lens system 52 may be divided into three or more sections, in essentially the same way as the gun-side electrode is divided into two sections in the lens system 52*f* FIG. 19. The resulting lens system will then be comprised of five or more electrodes.

Figure 20:
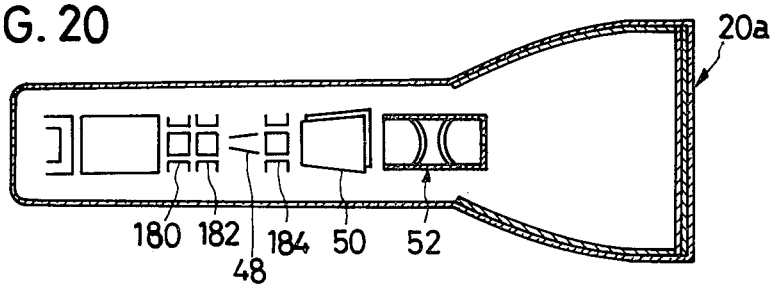
FIG. 20 is a schematic longitudinal sectional view of a different type of CRT employing the lens system of FIGS. 2 through 7.

In FIG. 20 the lens system 52 according to the invention is shown incorporated, in place of the conventional mesh, in a CRT 20*a*, having three quadrupolar lenses 180, 182 and 184. The quadrupolar lenses 180 and 182 take the places of the first 44 and second 46 anodes in the CRT 20 of FIG. 1, and the other quadrupolar lens 184 lies between vertical 48 and horizontal 50 deflection plate pairs. In this CRT 20*a* the quadrupolar lens 184 magnifies the vertical deflection of the electron beam, and the beam is converged to the same extent in both vertical and horizontal directions.

In the operation of the CRT 20*a*, −400 to 0 V may be applied to the vertical pair (top and bottom) of electrodes of the quadrupolar lens 182, and +400 V to its horizontal pair (right and left) of electrodes. +400 V may be applied to the top and bottom electrodes of the quadrupolar lens 180, and −400 to 0 V to its right and left electrodes. −300 to −100 V may be applied to the right and left electrodes of the quadrupolar lens 184, and 0 V to its top and bottom electrodes. Thus constructed and operated, the CRT 20*a* earns the same advantages as the CRT 20 of FIG. 1.

Figure 21:
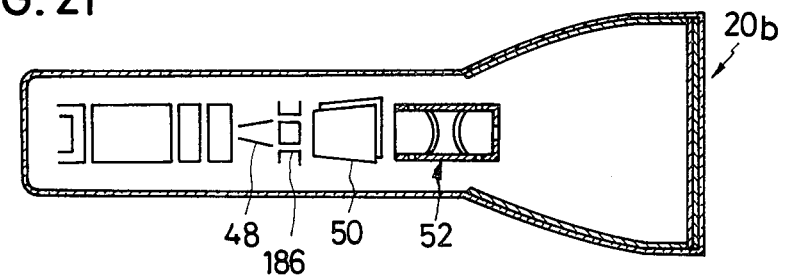
FIG. 21 is a schematic longitudinal sectional view of another different type of CRT also employing the lens system of FIGS. 2 through 7.

FIG. 21 shows still another different type of CRT 20*b* to which the lens system according to the invention is applicable. This CRT 20*b* differs from that of FIG. 1 only in that a quadrupolar lens 186 is interposed between vertical 48 and horizontal 50 deflection plate pairs. The right and left electrode of the quadrupolar lens 186 may be maintained at −300 to −100 V, and its top and bottom electrodes at 0 V. In this application, too, the lens system according to the invention will perform its intended functions to the full.

Additional changes, modifications and adaptations of the present invention will readily occur to those skilled in the art. For example, instead of disposing the apertured end plate 100 at right angles with the pair of opposite sides 92 and 94 of the target-side electrode 60, the end plate portions above and below the aperture 108 may be angled toward the target. Also the aperture 108 may not necessarily be exactly rectangular in shape as shown but may, for example, have its top and bottom, or right and left, sides curved slightly.

Further, in the modified lens system 52*a*, 52*b*, 52*c* and 52*e* shown respectively in FIGS. 14, 15, 16 and 18, the opposed ends of the electrodes may be convexed in the same directions as in the lens system 52*d* of FIG. 17. It is also possible to divide the postaccelerating electrode 54 into a plurality of sections.

Still further the present invention is applicable not only to CRTs including electron guns of the electrostatic focus type but also to those having guns of the electromagnetic focus variety. The illustrated electrostatic deflection system could also be replaced by an electromagnetic deflection system. As has been mentioned, moreover, the invention is adaptable not only for the illustrated oscilloscope CRTs but also for storage CRTs.

In view of the above suggested possibilities for additional changes, modifications and adaptations of the present invention, it is appropriate that the invention be constructed broadly and in a manner consistent with the fair meaning or proper scope of the following claims.

I claim:

1. A cathode ray tube of the type having a target, an electron gun for producing a beam of electrons directed toward the target, deflection means disposed along the path of the beam for deflecting the beam in two orthogonal directions, and a postaccelerating electrode surrounding the path of the beam on its way from the deflection means to the target, wherein the improvement comprises:

(a) a scan expansion lens system disposed between the deflection means and the target and in such a position that at least the target-side end of the lens system is acted upon by the field of the postaccelerating electrode, the lens system comprising:

(1) first, second, and third tubular electrodes of substantially rectangular cross-sectional shape disposed in axial alignment to permit the passage of the beam therethrough and spaced apart from one another with a gap sufficient to provide electrical insulation therebetween, each electrode having a beam entrance end directed toward the electron gun and a beam exit end directed toward the target;

(2) the first electrode comprising a first pair of opposite sides disposed in one of said two orthogonal directions and a second pair of opposite sides disposed at right angles with the first pair of opposite sides, the beam exit ends of the first pair of opposite sides being each curved in an arc that is convex in a first direction;

(3) the second electrode comprising a third pair of opposite sides disposed in said one of the orthogonal directions and a fourth pair of opposite sides disposed at right angles with the third pair of opposite sides, the beam entrance ends of the third pair of opposite sides being each curved in an arc that is convex in said first direction and which is in conformity with the arcs of the beam exit ends of the first pair of opposite sides of the first electrode, the beam exit ends of the third pair of opposite sides being each curved in an arc that is convex in a second position opposite to said first direction;

(4) the third electrode comprising a fifth pair of opposite sides disposed in said one of the orthogonal directions and a sixth pair of opposite sides disposed at right angles with the fifth pair of opposite sides, the beam entrance ends of the fifth pair of opposite sides being each curved in an arc that is convex in said second direction and which is in conformity with the arcs of the beam exit ends of the third pair of opposite sides of the second electrode;

(5) the third electrode further comprising an end plate closing the beam exit end thereof, the end plate having formed therein an aperture which is elongated in said one of the orthogonal directions and whose geometrical center substantially coincides with the axis of the beam passing the aperture without being deflected by the deflection means;

(b) means for applying such electrical potentials to the first, second, and third electrodes of the lens system and to the postaccelerating electrode that there are created:

(1) a diverging electron lens within the lens system to act on the beam in said one of the orthogonal directions;

(2) a first converging electron lens within the lens system to act on the beam in the other of the orthogonal directions for focusing the beam at a point before the aperture in the end plate of the third electrode, the first converging electron lens converging the beam to a greater extent when the beam is deflected by the deflection means in said other of the orthogonal directions than when the beam is not deflected in said other of the orthogonal directions; and (3) a second converging electron lens adjacent the aperture in the end plate of the third electrode to act on the beam in said other of the orthogonal directions as the beam enters the second converging electron lens in a diverging state after being converged by the first converging electron lens, the second converging electron lens being created owing to a potential difference between the third electrode of the lens system and the postaccelerating electrode and converging the beam to a greater extent when the beam is not deflected by the deflection means in said other of the orthogonal directions than when the beam is deflected in said other of the orthogonal directions.

2. The cathode ray tube according to claim 1, wherein the beam exit ends of the second pair of opposite sides are each curved in an arc that is convex in said second direction, wherein the beam entrance ends of the fourth pair of opposite sides are each curved in an arc that is convex in said second direction and which is in conformity with the arcs of the beam exit ends of the second pair of opposite sides, wherein the beam exit ends of the fourth pair of opposite sides are each curved in an arc that is convex in said first direction, and wherein the beam entrance ends of the sixth pair of opposite sides are each curved in an arc that is convex in said first direction and which is in conformity with the arcs of the beam exit ends of the fourth pair of opposite sides.

3. The cathode ray tube according to claim 1, wherein said first direction is toward the electron gun, wherein said second direction is toward the target, and wherein the applying means apply a potential lower than the potential of the postaccelerating electrode to the first electrode of the lens system, a potential lower than the potential of the first electrode to the second electrode, and a potential intermediate the potential of the second electrode and the potential of the postaccelerating electrode to the third electrode.

4. The cathode ray tube according to claim 1, wherein said first direction is toward the target, and wherein said second direction is toward the electron gun, and wherein the applying means apply a potential lower than the potential of the postaccelerating electrode to the first electrode of the lens system, a potential intermediate the potential of the first electrode and the potential of the postaccelerating electrode to the second electrode, and a potential lower than the potential of the second electrode to the third electrode.

5. The cathode ray tube according to claims 3 or 4, wherein the applying means apply ground potential to the first and third electrodes of the lens system.

6. The cathode ray tube according to claims 1, 2 or 3 4 wherein the first, third and fifth pairs of opposite sides of the electrodes of the lens system gradually increase in width from the beam entrance end to the beam exit end of the lens system.

7. The cathode ray tube according to claim 6, wherein the first, third and fifth pairs of opposite sides of the electrodes of the lens system are substantially bell-shaped.

8. The cathode ray tube according to claims 1, 2, 3 or 4, wherein the lens system is generally box-shaped.

9. The cathode ray tube according to claims 1, 2, 3 or 4, wherein the beam exit ends of the fifth pair of opposite sides of the third electrode and its apertured end plate are curved in an arc convex toward the target.

10. The cathode ray tube according to claims 1, 2, 3 or 4, wherein the electrodes of the lens system are each of substantially elliptical cross-sectional shape.

11. The cathode ray tube according to claim 1, wherein the dimension of the aperture in the end plate of the third electrode in said other of the orthogonal directions is in the range of from about 1/5 to 3/5 of the dimension of the lens system in said other of the orthogonal directions.

12. The cathode ray tube according to claims 11 or 1, wherein the dimension of the beam exit end of the lens system in said one of the orthogonal direction is from about 2.5 to 5.0 times the dimension of the lens system in said other of the orthogonal directions.

* * * * *

UNITED STATES PATENT AND TRADEMARK OFFICE

CERTIFICATE OF CORRECTION

PATENT NO. : 4,302,704

DATED : November 24, 1981

INVENTOR(S) : Kimiharu Saito

It is certified that error appears in the above-identified patent and that said Letters Patent are hereby corrected as shown below:

On the title page, abstract, line 12, "to" should read -- in --

Column 12, line 30, "56f" should read --56f'--.
line 31, "62f" should read --62f'--;
"64f" should read --64f'--;
"66f" should read --66f'--.
line 32, "68f" should read --68f'--.
line 35, "62f" should read --62f'--;
"64f" should read --64f'--;
"56f" should read --56f'--.
line 41, "66f" should read --66f'--;
"68f" should read --68f'--;
"56f" should read --56f'--.
line 44, "56f" should read --56f'--.
line 47, "62f" should read --62f'--;
"64f" should read --64f'--;
"56f" should read --56f'--.
line 49, "66f" should read --66f'--.
line 50, "68f" should read --68f'--;
"56f" should read --56f'--.

UNITED STATES PATENT AND TRADEMARK OFFICE

CERTIFICATE OF CORRECTION

PATENT NO. : 4,302,704

DATED : November 24, 1981

INVENTOR(S) : Kimiharu Saito

It is certified that error appears in the above-identified patent and that said Letters Patent are hereby corrected as shown below:

Column 12, line 56, "56f" should read --56f'--.
line 60, "56f" should read --56f'--.
line 66, after "52f" insert --of--.

Column 16, line 17, delete "or" and insert therefor --,--.
line 18, before "4" insert --or--.

Signed and Sealed this

*Twenty-third* Day of *November 1982*

[SEAL]

*Attest:*

GERALD J MOSSINGHOFF

*Attesting Officer*

*Commissioner of Patents and Trademarks*